US010136774B2

(12) United States Patent
Blanchard

(10) Patent No.: US 10,136,774 B2
(45) Date of Patent: Nov. 27, 2018

(54) COZY COMFORT TOILET SEAT COVER: THE FLEECE SEAT

(71) Applicant: Kerri Anne Blanchard, Raleigh, NC (US)

(72) Inventor: Kerri Anne Blanchard, Raleigh, NC (US)

(73) Assignee: Kerri Anne Blanchard, Raleigh, NC (US)

( * ) Notice: Subject to any disclaimer, the term of this patent is extended or adjusted under 35 U.S.C. 154(b) by 0 days.

(21) Appl. No.: 15/374,021

(22) Filed: Dec. 9, 2016

(65) Prior Publication Data

US 2017/0135536 A1 May 18, 2017

Related U.S. Application Data

(63) Continuation of application No. 14/666,260, filed on Mar. 23, 2015.

(51) Int. Cl.

| | |
|---|---|
| ***A47K 13/14*** | (2006.01) |
| ***A47K 13/16*** | (2006.01) |
| *A47K 13/02* | (2006.01) |

(52) U.S. Cl.

CPC ..... *A47K 13/14* (2013.01); *A47K 13/16* (2013.01); *A47K 13/02* (2013.01)

(58) Field of Classification Search

CPC ..... A47K 13/00; A47K 13/005; A47K 13/02; A47K 13/14; A47K 13/16

USPC ..... 4/245.1, 245.3, 245.5, 245.6; 297/218.1

See application file for complete search history.

(56) References Cited

U.S. PATENT DOCUMENTS

| | | | | |
|---|---|---|---|---|
| 1,088,090 | A | 2/1914 | Quackenbush | |
| 1,377,791 | A * | 5/1921 | Potschner | A47K 13/16 4/245.9 |
| 1,538,147 | A * | 5/1925 | Trench | B62D 1/06 16/DIG. 12 |
| 1,706,960 | A | 3/1929 | Kobatake | |
| 2,706,767 | A | 3/1955 | Packchanian | |
| 2,994,887 | A | 8/1961 | Thornton | |
| 3,102,276 | A | 9/1963 | Warnberg | |
| 3,653,076 | A | 4/1972 | Warnberg | |
| 4,130,906 | A | 12/1978 | Robertson | |
| 4,227,267 | A | 10/1980 | Robertson | |
| 5,193,229 | A | 3/1993 | Smith | |
| 5,461,732 | A | 10/1995 | Reiman | |
| 5,537,693 | A | 7/1996 | Dossola et al. | |
| 6,813,784 | B1 * | 11/2004 | Thompson | A47K 13/16 4/245.1 |

(Continued)

FOREIGN PATENT DOCUMENTS

DE 2504494 A1 8/1976

*Primary Examiner* — Erin Deery
(74) *Attorney, Agent, or Firm* — Coats & Bennett, PLLC

(57) ABSTRACT

The seat cover presented herein includes multiple inner and outer flaps that extend around a toilet seat, where each inner flap secures to one of the outer flaps to secure the seat cover to the toilet seat. To provide a tight fit, the solution presented herein further includes two hinge flaps that extend around the outer rim of the toilet seat proximate the hinges of the toilet seat and between two outer flaps. The hinge flaps secure to an adjacent outer flap to more tightly secure the seat cover to the toilet seat. The solution presented herein may be used for any conventional toilet seat, e.g., round and/or oval toilet seats.

14 Claims, 6 Drawing Sheets

(56) References Cited

U.S. PATENT DOCUMENTS

| | | | |
|---|---|---|---|
| 2010/0205733 | A1 | 8/2010 | Chen |
| 2012/0222203 | A1 | 9/2012 | Hiltz |

* cited by examiner

COZY COMFORT TOILET SEAT COVER: THE FLEECE SEAT

The instant application is a continuation of currently pending U.S. application Ser. No. 14/666,260, filed 23 Mar. 2015, the entirety of which is incorporated herein by reference.

BACKGROUND

Many households lower the thermostat at night to save energy. As a result, the toilet seats, which are often made of plastic or metal, may become uncomfortably cold. To address this problem, some people may cover the toilet seat with some kind of cover.

Conventional covers for toilet seats typically use elastic to secure the cover to the toilet seat. While elastic makes it easier to remove the seat cover from the toilet seat, e.g., for washing, the elastic generally wears out quickly when frequency washed and dried, making the seat cover too loose and/or unusable. Thus, there remains a need for a toilet seat cover that is easy to remove and is able to secure tightly to the toilet seat while also withstanding many removals and washings without losing it shape and/or ability to secure tightly to the toilet seat.

SUMMARY

The solution presented herein comprises a seat cover that includes multiple inner and outer flaps that extend around the toilet seat, where each inner flap secures to one of the outer flaps to secure the seat cover to a toilet seat. In one exemplary embodiment, each inner flap secures to the corresponding outer flap using a hook and loop fastener. To provide a tight fit, the solution presented herein further includes two hinge flaps that extend around the outer rim of the toilet seat proximate the hinges and secure to another adjacent outer flap, e.g., using a hook and loop fastener. In so doing, the solution presented herein provides a seat cover that is easily removed, e.g., for washing, and easily and tightly secured to the toilet seat.

One exemplary embodiment comprises a seat cover for a toilet seat configured to hingedly connect to a toilet base via two spaced apart hinges. The toilet seat comprises an inner rim defining an opening of the toilet seat, an opposing outer rim including a rear portion proximate the two spaced apart hinges, a top side spanning between the inner and outer rims, and an opposing bottom side spanning between the inner and outer rims. The seat cover comprises a seat surface, a plurality of outer flaps, a plurality of inner flaps, and first and second hinge flaps. The seat surface comprises a ring of material having a top surface and an opposing bottom surface, where the top and bottom surfaces span between an inner peripheral edge and an outer peripheral edge. The inner peripheral edge defines a center opening of the seat cover. The plurality of outer flaps comprise a plurality of outer flaps along the outer peripheral edge, and include a rear outer flap disposed along a rear outer peripheral edge of the seat cover and configured to fit between the two spaced apart hinges. The plurality of inner flaps comprise a plurality of inner flaps along the inner peripheral edge. The first and second hinge flaps are along the outer peripheral edge. The first hinge flap is disposed between the rear outer flap and one of the plurality of outer flaps adjacent the rear outer flap. The second hinge flap is disposed between the rear outer flap and another of the plurality of outer flaps adjacent the rear outer flap. Each outer flap is configured to extend around the outer rim of the toilet seat and each inner flap is configured to extend around the inner rim of the toilet seat such that each inner flap secures to a corresponding outer flap at the bottom side of the toilet seat to secure the bottom surface of the seat cover to the top side of the toilet seat. Each of the first and second hinge flaps is configured to extend around the outer rim of the toilet seat. A distal end of each of the first and second hinge flaps is configured to secure to the corresponding outer flap adjacent the rear outer flap.

Another exemplary embodiment comprises a seat cover for a toilet seat configured to hingedly connect to a toilet base via two spaced apart hinges. The toilet seat comprises an inner rim defining an opening of the toilet seat, an opposing outer rim including a rear portion proximate the two spaced apart hinges, a top side spanning between the inner and outer rims, and an opposing bottom side spanning between the inner and outer rims. The seat cover comprises a seat surface, a plurality of outer flaps, and a plurality of inner flaps. The seat surface comprises a ring of material having a top surface and an opposing bottom surface. The top and bottom surfaces span between an inner peripheral edge and an outer peripheral edge. The inner peripheral edge defines a center opening of the seat cover. The plurality of outer flaps comprise a plurality of outer flaps along the outer peripheral edge. The plurality of inner flaps comprise a plurality of inner flaps along the inner peripheral edge. Each outer flap is configured to extend around the outer rim of the toilet seat and each inner flap is configured to extend around the inner rim of the toilet seat such that each inner flap secures to a corresponding outer flap at the bottom side of the toilet seat to secure the bottom surface of the seat cover to the top side of the toilet seat. The plurality of outer and inner flaps comprise first through sixth outer flaps and first through fourth inner flaps. The first outer flap is disposed along a rear outer peripheral edge of the seat cover and configured to fit between the two spaced apart hinges when extended around a rear outer rim of the toilet seat and secure to a corresponding first inner flap. The second outer flap is disposed on a front outer peripheral edge of the seat cover opposite the rear outer peripheral edge and configured to extend around a front outer rim of the toilet seat and secure to a corresponding second inner flap. A pair of third outer flaps are disposed along one side outer peripheral edge of the seat cover between the first outer flap and the second outer flap. Each third outer flap is configured to extend around a lateral outer rim of the toilet seat and secure to a corresponding third inner flap. The pair of third outer flaps comprises a rear third outer flap disposed proximate the first outer flap and a front third outer flap disposed proximate the second outer flap. A pair of fourth outer flaps are disposed along another side outer peripheral edge of the seat cover between the first outer flap and the second outer flap. Each fourth outer flap is configured to extend around another lateral outer rim of the toilet seat and secure to a corresponding fourth inner flap. The pair of fourth outer flaps comprises a rear fourth outer flap disposed proximate the first outer flap and a front fourth outer flap disposed proximate the second outer flap. The fifth outer flap is disposed along the rear outer peripheral edge of the seat cover between the first outer flap and the rear third outer flap. The fifth outer flap is configured to extend around at least a portion of the rear outer rim of the toilet seat adjacent one of the two spaced apart hinges and secure to the rear third outer flap. The sixth outer flap is disposed along the rear outer peripheral edge of the seat cover between the first outer flap and the fourth rear outer flap. The sixth outer flap is configured to extend around at least a portion of the rear outer rim of the toilet seat adjacent the other one of the two spaced apart hinges and secure to the rear fourth outer flap.

DETAILED DESCRIPTION

Figure 1:
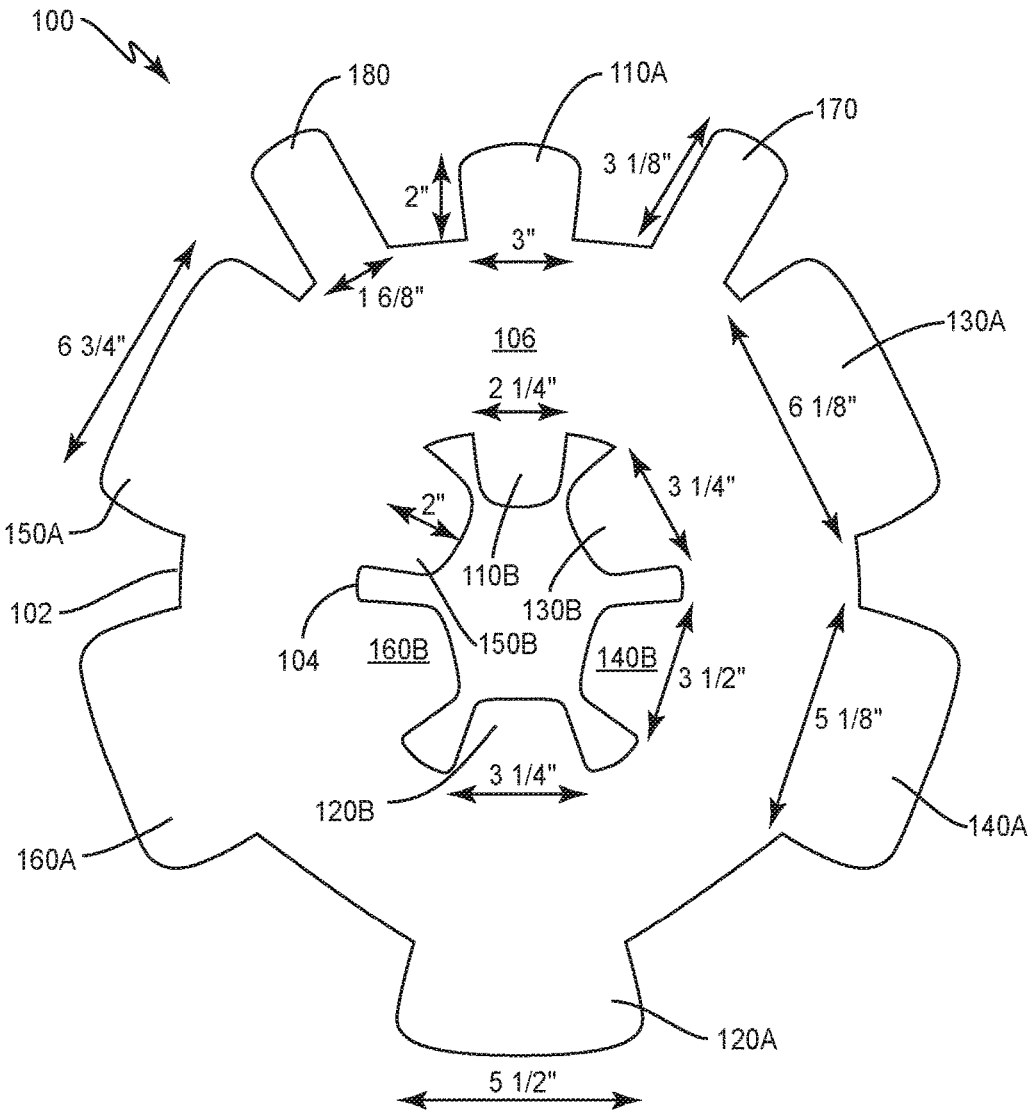
FIG. 1 shows a seat cover for a round toilet seat according to one exemplary embodiment, including exemplary dimensions.

FIGS. 1, 2A, 2B, 3A, and 3B show one exemplary seat cover 100 for a toilet seat 10, e.g., a round toilet seat that hingedly connects to a toilet base via two spaced apart hinges 12. For purposes of discussion, it will be appreciated that the toilet seat 10 comprises an inner rim defining an opening of the toilet seat, an opposing outer rim including a rear portion proximate the hinges 12, a top side spanning between the inner and outer rims, and an opposing bottom side spanning between the inner and outer rims.

Seat cover 100 includes a seat surface comprising a ring of material having a top surface 106 and an opposing bottom surface 108, where the top and bottom surfaces 106, 108 span between an inner peripheral edge 104 and an outer peripheral edge 102, and where the inner peripheral edge 102 defines a center opening of the seat cover 100. In one exemplary embodiment, the material comprises a fleece material, e.g., a polyester fleece material.

The seat cover 100 comprises a plurality of outer flaps 110A-160A along the outer peripheral edge 102, a plurality of inner flaps 110B-106B along the inner peripheral edge 104, a first hinge flap 170, and a second hinge flap 180. In some embodiments, one or more of the flaps 110A-160A, 110B-160B, 170, 180 may be tapered. The plurality of outer flaps include a rear outer flap 110A disposed along a rear outer peripheral edge of the seat cover 100 and configured to fit between the two spaced apart hinges 12. The first hinge flap 170 is disposed between the rear outer flap 110A and the outer flap 130A adjacent one side of the rear outer flap 110A. The second hinge flap 180 is disposed between the rear outer flap 110A and the outer flap 150A adjacent the other side of rear outer flap 110A. Each outer flap 110A-160A is configured to extend around the outer rim of the toilet seat 10 and each inner flap 110B-160B is configured to extend around the inner rim of the toilet seat 10 such that each inner flap 110B-160B secures to a corresponding outer flap 110A-160A at the bottom side of the toilet seat 10 to secure the bottom surface 108 of the seat cover 100 to the top side of the toilet seat 10 (see FIGS. 3A and 3B). The first hinge flap 170 is configured to extend around the outer rim of the toilet seat 10, where a distal end of the first hinge flap 170 is configured to secure to adjacent outer flap 130A. The second hinge flap 180 is configured to extend around the outer rim of the toilet seat 10, where a distal end of the second hinge flap 180 is configured to secure to adjacent outer flap 150A.

In more detail, the plurality of outer flaps comprise a first outer flap 110A, a second outer flap 120A, a pair of third outer flaps 130A, 140A, a pair of fourth outer flaps 150A, 160A, and fifth and sixth outer flaps 170, 180, which are also referred to herein as first and second hinge flaps 170, 180. The plurality of inner flaps comprise a first inner flap 110B, a second inner flap 120B, a pair of third inner flaps 130B, 140B, and a pair of fourth inner flaps 150B, 160B. The first outer flap 110A is disposed along a rear outer peripheral edge of the seat cover 100 and configured to fit between the two spaced apart hinges 12 when extended around a rear outer rim of the toilet seat 10 and secure to the corresponding first inner flap 110B. The second outer flap 120A is disposed on a front outer peripheral edge of the seat cover 100 opposite the rear outer peripheral edge and configured to extend around a front outer rim of the toilet seat 10 and secure to the corresponding second inner flap 120B. The pair of third outer flaps 130A, 140A are disposed along one side outer peripheral edge of the seat cover 100 between the first outer flap 110A and the second outer flap 120A. Each third outer flap 130A, 140A is configured to extend around a lateral outer rim of the toilet seat 10 and secure to a corresponding third inner flap 130B, 140B. The pair of third outer flaps 130A, 140A comprises a rear third outer flap 130A disposed proximate the first outer flap 110A and a front third outer flap 140 A disposed proximate the second outer flap 120A. The pair of fourth outer flaps 150A, 160A are disposed along another side outer peripheral edge of the seat cover 100 between the first outer flap 110A and the second outer flap 120A. Each fourth outer flap 150A, 160A is configured to extend around another lateral outer rim of the toilet seat 10 and secure to a corresponding fourth inner flap 150B, 160B. The pair of fourth outer flaps 150A, 160A comprises a rear fourth outer flap 150A disposed proximate the first outer flap 110A and a front fourth outer flap 160A disposed proximate the second outer flap 120A. A fifth outer flap 170, also referred to herein as a first hinge flap 170, is disposed along the rear outer peripheral edge of the seat cover 100 between the first outer flap 110A and the rear third outer flap 130A. The fifth outer flap 170 is configured to extend around at least a portion of the rear outer rim of the toilet seat 10 adjacent one of the two spaced apart hinges 12 and secure to the rear third outer flap 130A. A sixth outer flap 180, also referred to herein as a second hinge flap 180, is disposed along the rear outer peripheral edge of the seat cover 100 between the first outer flap 110A and the fourth rear outer flap 150A. The sixth outer flap 180 is configured to extend around at least a portion of the rear outer rim of the toilet seat 10 adjacent the other one of the two spaced apart hinges 12 and secure to the rear fourth outer flap 150A.

Figure 2A:
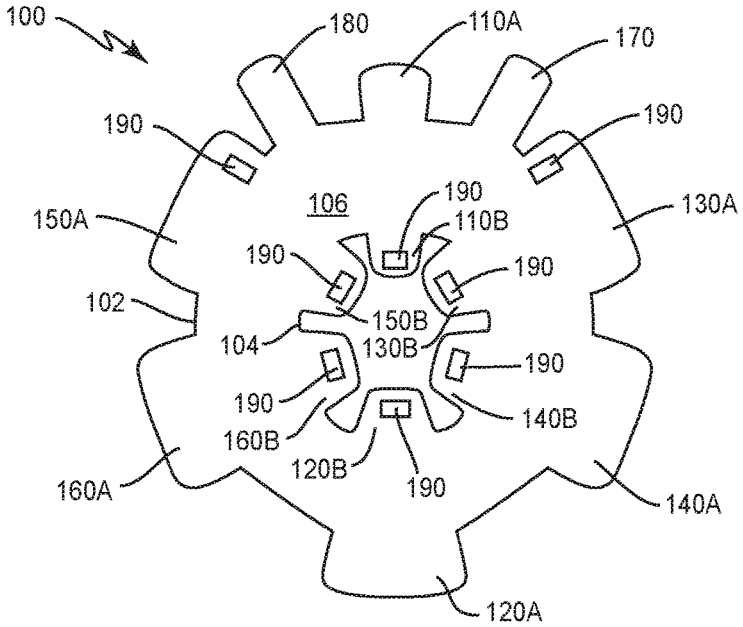
FIGS. 2A-2B show a top view and a bottom view, respectively, for the exemplary seat cover of FIG. 1, including exemplary fastener placement.
Figure 2B:
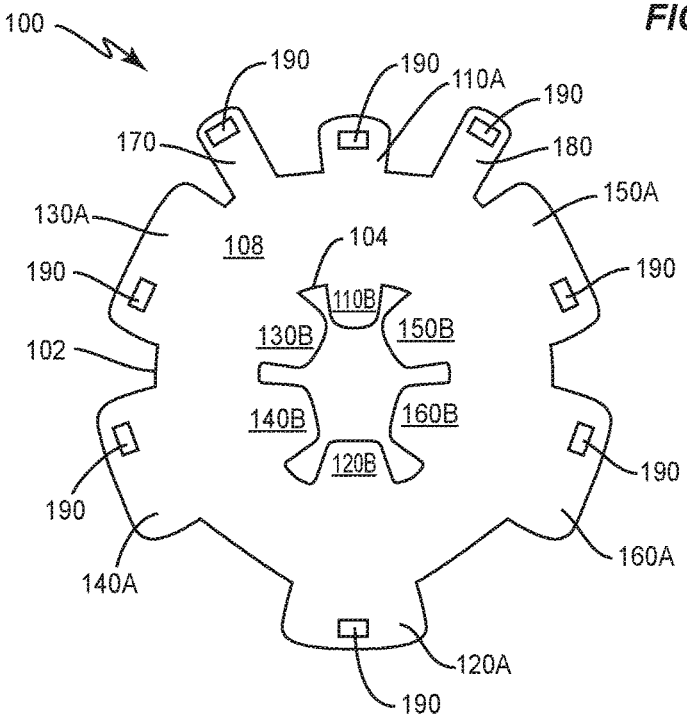
Figure 3A:
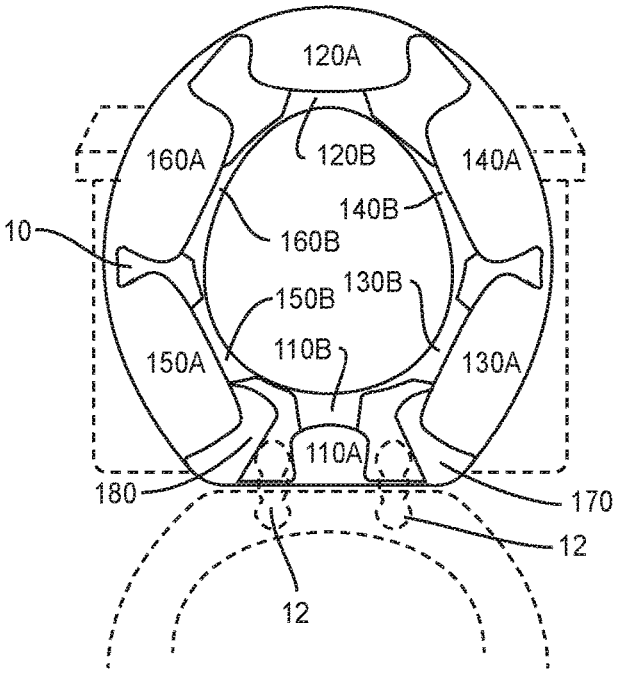
FIGS. 3A-3B show the exemplary seat cover of FIG. 1 secured to a toilet seat.
Figure 3B:
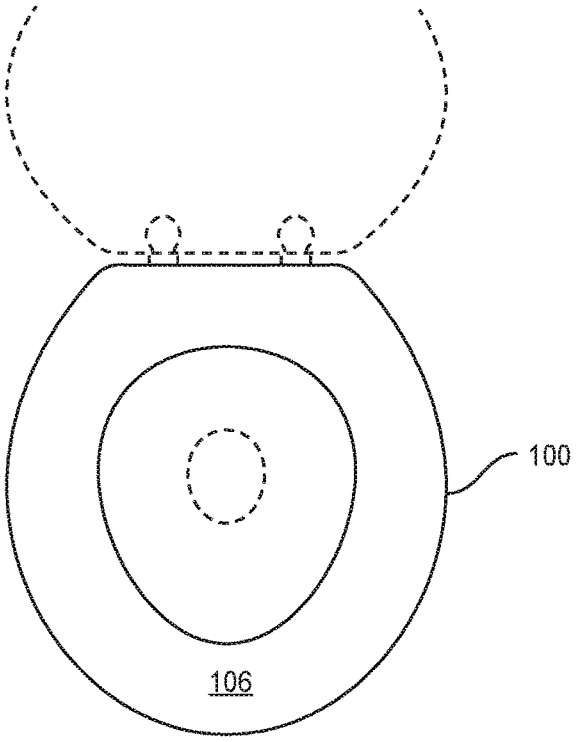

FIG. 1 shows exemplary measurements for each of the inner and outer tabs for a an exemplary round toilet seat 10, while FIGS. 2A and 2B show an exemplary placement of multiple fasteners 190 used to secure the inner flaps 110B-160B to the outer flaps 110A-160A and the first and second hinges 170, 180 to the corresponding outer flaps 130A, 150A to secure the seat cover 100 to the round toilet seat 10. Exemplary fasteners 190 include hook and loop fasteners, where a male hook and loop fastener 190 is secured, e.g., stitched, to one of the outer and inner flaps 110A-160A, 110B-160B and the corresponding female hook and loop fastener 190 is secured, e.g., stitched, to the other of the outer and inner flaps 110A-160A, 110B-160B, and where a male hook and loop fastener 190 is secured, e.g., stitched, to one of the first and second hinge flaps 170, 180 and the corresponding female hook and loop fastener 190 is secured, e.g., stitched, to the other of the adjacent outer flaps 130A, 150A such that the corresponding flaps tightly secure the seat cover 100 to the toilet seat 10. It will be appreciated that size of the inner and outer flaps 110A-160A, 110B-160B and the placement of the fasteners 190 shown in FIGS. 2A and 2B is approximate and is for illustration purposes only, and that the actual size of the inner and outer flaps 110A-160A, 110B-160B and the actual placement of the fasteners will depend on the size of the toilet seat 10. As shown in at least FIG. 1, a rear outer peripheral edge 102 (proximate the hinges 12) of the seat cover 100 may be curved or arced. In this embodiment, the outer flap 110A and the hinge flaps 170, 180 are disposed along the arced outer peripheral edge 102 at the rear of the seat cover 100.

FIGS. 4, 5A, 5B, 6A, and 6B show another exemplary seat cover 200 for another toilet seat 10, e.g., an oval toilet seat that hingedly connects to a toilet base via two spaced apart hinges 12. For purposes of discussion, it will be appreciated that the toilet seat 10 comprises an inner rim defining an opening of the toilet seat, an opposing outer rim including a rear portion proximate the hinges 12, a top side spanning between the inner and outer rims, and an opposing bottom side spanning between the inner and outer rims.

Seat cover 200 includes a seat surface comprising a ring of material having a top surface 206 and an opposing bottom surface 208, where the top and bottom surfaces 206, 208 span between an inner peripheral edge 204 and an outer peripheral edge 202, and where the inner peripheral edge 202 defines a center opening of the seat cover 200. In one exemplary embodiment, the material comprises a fleece material, e.g., a polyester fleece material.

Seat cover 200 comprises a plurality of outer flaps 210A-260A along the outer peripheral edge 202, a plurality of inner flaps 210B-206B along the inner peripheral edge 204, a first hinge flap 270, and a second hinge flap 280. In some embodiments, one or more of the flaps 210A-260A, 210B-260B, 270, 280 may be tapered. The plurality of outer flaps 210A-260A include a rear outer flap 210A disposed along a rear outer peripheral edge of the seat cover 200 and configured to fit between the two spaced apart hinges 12. The first hinge flap 270 is disposed between the rear outer flap 210A and the outer flap 230A adjacent one side of the rear outer flap 210A. The second hinge flap 280 is disposed between the rear outer flap 210A and the outer flap 250A adjacent the other side of rear outer flap 210A. Each outer flap 210A-260A is configured to extend around the outer rim of the toilet seat 10 and each inner flap 210B-260B is configured to extend around the inner rim of the toilet seat 10 such that each inner flap 210B-260B secures to a corresponding outer flap 210A-260A at the bottom side of the toilet seat 10 to secure the bottom surface 208 of the seat cover 200 to the top side of the toilet seat 10 (see FIGS. 6A and 6B). The first hinge flap 270 is configured to extend around the outer rim of the toilet seat 10, where a distal end of the first hinge flap 270 is configured to secure to adjacent outer flap 230A. The second hinge flap 280 is configured to extend around the outer rim of the toilet seat 10, where a distal end of the second hinge flap 280 is configured to secure to adjacent outer flap 250A.

In more detail, the plurality of outer flaps comprise a first outer flap 210A, a second outer flap 220A, a pair of third outer flaps 230A, 240A, a pair of fourth outer flaps 250A, 260A, and fifth and sixth outer flaps 270, 280, which are also referred to herein as first and second hinge flaps 270, 280. The plurality of inner flaps comprise a first inner flap 210B, a second inner flap 220B, a pair of third inner flaps 230B, 240B, and a pair of fourth inner flaps 250B, 260B. The first outer flap 210A is disposed along a rear outer peripheral edge of the seat cover 200 and configured to fit between the two spaced apart hinges 12 when extended around a rear outer rim of the toilet seat 10 and secure to the corresponding first inner flap 210B. The second outer flap 120A is disposed on a front outer peripheral edge of the seat cover 200 opposite the rear outer peripheral edge and configured to extend around a front outer rim of the toilet seat 10 and secure to the corresponding second inner flap 220B. The pair of third outer flaps 230A, 240A are disposed along one side outer peripheral edge of the seat cover 200 between the first outer flap 210A and the second outer flap 220A. Each third outer flap 230A, 240A is configured to extend around a lateral outer rim of the toilet seat 10 and secure to a corresponding third inner flap 230B, 240B. The pair of third outer flaps 230A, 240A comprises a rear third outer flap 230A disposed proximate the first outer flap 210A and a front third outer flap 240 A disposed proximate the second outer flap 220A. The pair of fourth outer flaps 250A, 260A are disposed along another side outer peripheral edge of the seat cover 200 between the first outer flap 210A and the second outer flap 220A. Each fourth outer flap 250A, 260A is configured to extend around another lateral outer rim of the toilet seat 10 and secure to a corresponding fourth inner flap 250B, 260B. The pair of fourth outer flaps 250A, 260A comprises a rear fourth outer flap 250A disposed proximate the first outer flap 210A and a front fourth outer flap 260A disposed proximate the second outer flap 220A. A fifth outer flap 270, also referred to herein as a first hinge flap 270, is disposed along the rear outer peripheral edge of the seat cover 200 between the first outer flap 210A and the rear third outer flap 230A. The fifth outer flap 270 is configured to extend around at least a portion of the rear outer rim of the toilet seat 10 adjacent one of the two spaced apart hinges 12 and secure to the rear third outer flap 230A. A sixth outer flap 280, also referred to herein as a second hinge flap 280, is disposed along the rear outer peripheral edge of the seat cover 100 between the first outer flap 210A and the fourth rear outer flap 250A. The sixth outer flap 280 is configured to extend around at least a portion of the rear outer rim of the toilet seat 10 adjacent the other one of the two spaced apart hinges 12 and secure to the rear fourth outer flap 250A.

Figure 4:
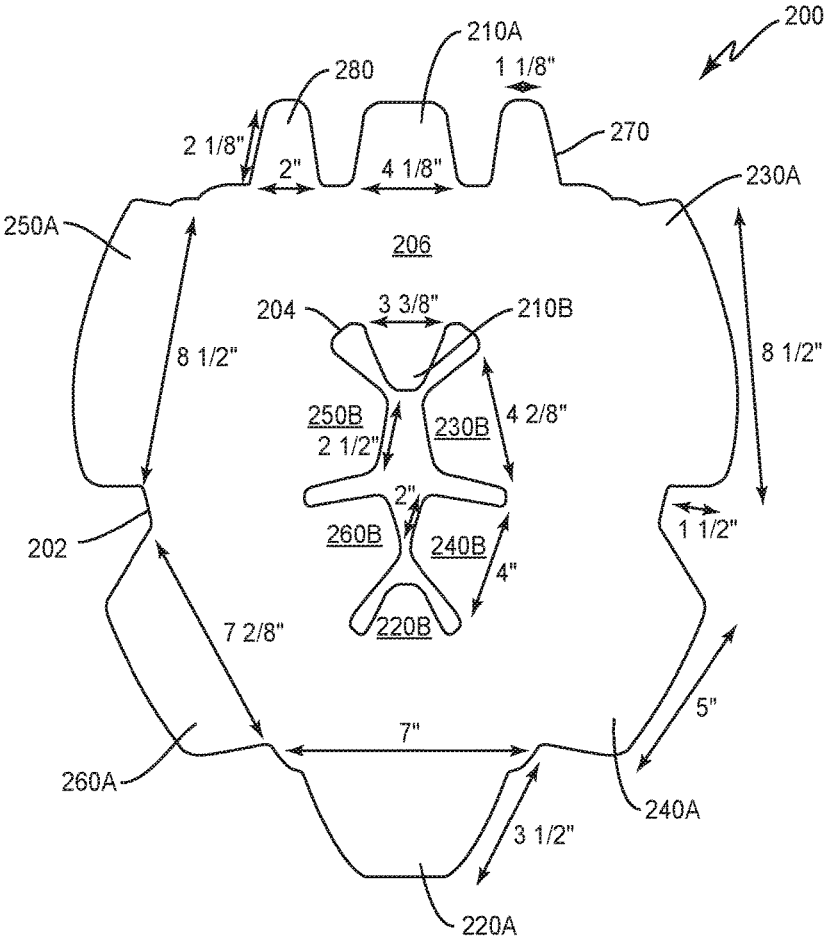
FIG. 4 shows a seat cover for an oval toilet seat according to one exemplary embodiment, including exemplary dimensions.
Figure 5A:
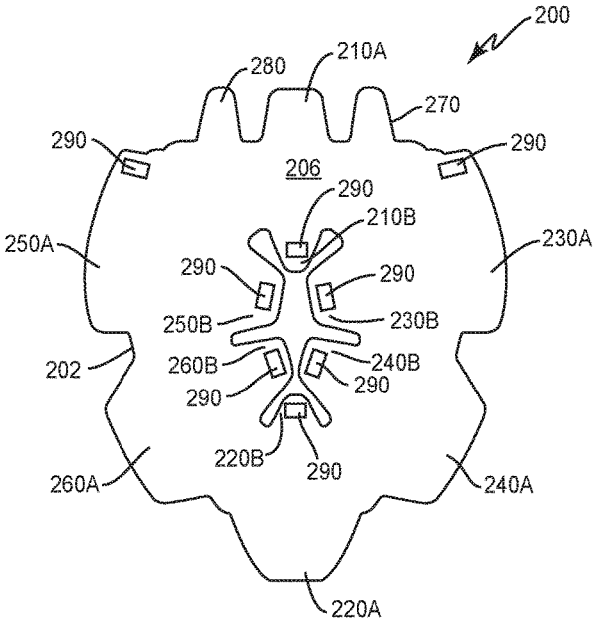
FIGS. 5A-5B show a top view and a bottom view, respectively, for the exemplary seat cover of FIG. 4, including exemplary fastener placement.
Figure 5B:
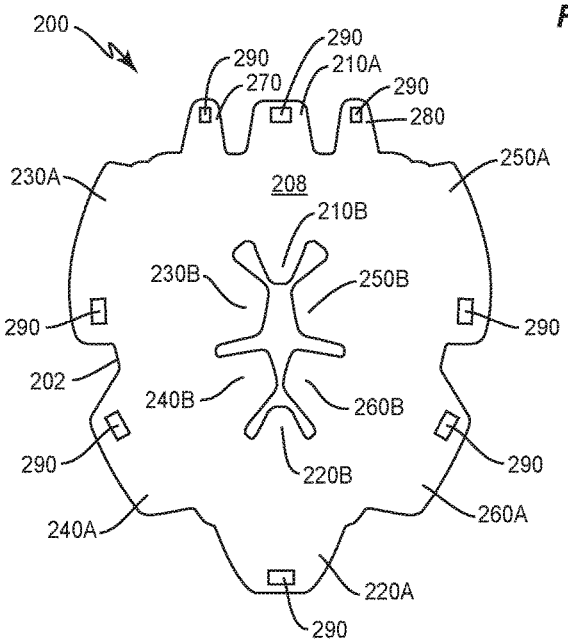
Figure 6A:
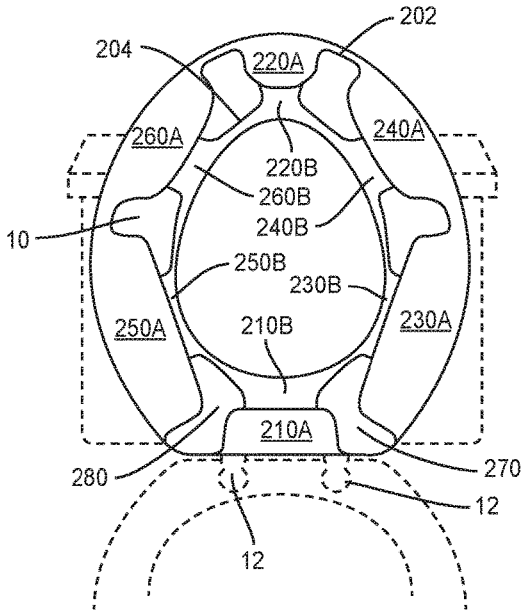
FIGS. 6A-6B show the exemplary seat cover of FIG. 4 secured to a toilet seat.
Figure 6B:
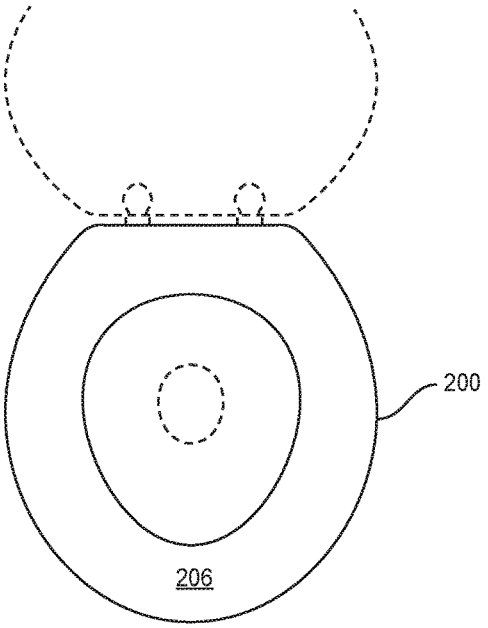

FIG. 4 shows exemplary measurements for each of the inner and outer tabs for a an exemplary oval toilet seat 10, while FIGS. 5A and 5B show an exemplary placement of multiple fasteners 290 used to secure the inner flaps 210B-260B to the outer flaps 210A-260A and the first and second hinges 270, 280 to the corresponding outer flaps 230A, 250A to secure the seat cover 200 to the round toilet seat 10. Exemplary fasteners 290 include hook and loop fasteners, where a male hook and loop fastener 290 is secured, e.g., stitched, to one of the outer and inner flaps 210A-260A, 210B-260B and the corresponding female hook and loop fastener 290 is secured, e.g., stitched, to the other of the outer and inner flaps 210A-260A, 210B-260B, and where a male hook and loop fastener 290 is secured, e.g., stitched, to one of the first and second hinge flaps 270, 280 and the corresponding female hook and loop fastener 290 is secured, e.g., stitched, to the other of the adjacent outer flaps 230A, 250A such that the corresponding flaps tightly secure the seat cover 200 to the toilet seat 10. It will be appreciated that size of the inner and outer flaps 210A-260A, 210B-260B and the placement of the fasteners 190 shown in FIGS. 5A and 5B is approximate and is for illustration purposes only, and that the actual size of the inner and outer flaps 210A-260A, 210B-260B and the actual placement of the fasteners will depend on the size of the toilet seat 10. As shown in at least FIG. 4, a rear outer peripheral edge 202 (proximate hinges 12) of the seat cover 200 may be substantially straight. In this embodiment, the outer flap 210A and the hinge flaps 270, 280 are disposed along the substantially straight outer peripheral edge 202 at the rear of the seat cover 200.

The solution disclosed herein is durable and washable, and retains it's shape and function for years. The design of the seat cover 100, 200 allows the seat cover 100, 200 to fit securely and completely cover cold surfaces, which could contact the skin. Further, the solution disclosed herein saves money because it fits well on the toilet seat most people already have, and may even be used on a cracked vinyl and foam toilet seat to prolong it's use. In addition, the washability of solution presented herein makes it sanitary. Further, the use of material such as fleece eliminates the need to use electricity to warm the seat making the solution presented herein energy efficient.

The solution presented herein may, of course, be carried out in other ways than those specifically set forth herein without departing from essential characteristics of the invention. The present embodiments are to be considered in all respects as illustrative and not restrictive, and all changes coming within the meaning and equivalency range of the appended claims are intended to be embraced therein.

What is claimed is:

1. A seat cover for a toilet seat configured to hingedly connect to a toilet base via two spaced apart hinges, the toilet seat comprising an inner rim defining an opening of the toilet seat, an opposing outer rim including a rear portion proximate the two spaced apart hinges, a top side spanning between the inner and outer rims, and an opposing bottom side spanning between the inner and outer rims, the seat cover comprising:

a seat surface comprising a ring of material having a top surface and an opposing bottom surface, the top and bottom surfaces spanning between an inner peripheral edge and an outer peripheral edge, the inner peripheral edge defining a center opening of the seat cover;

a plurality of outer flaps along the outer peripheral edge, the plurality of outer flaps including a rear outer flap disposed along a rear outer peripheral edge of the seat cover and configured to fit between the two spaced apart hinges; and a plurality of inner flaps along the inner peripheral edge;

first and second hinge flaps along the outer peripheral edge, said first hinge flap disposed between the rear outer flap and one of the plurality of outer flaps adjacent the rear outer flap, and said second hinge flap disposed between the rear outer flap and another of the plurality of outer flaps adjacent the rear outer flap;

wherein each outer flap is configured to extend around the outer rim of the toilet seat and each inner flap is configured to extend around the inner rim of the toilet seat such that each inner flap secures to a corresponding outer flap at the bottom side of the toilet seat to secure the bottom surface of the seat cover to the top side of the toilet seat; and wherein each of the first and second hinge flaps is configured to extend around the outer rim of the toilet seat, and wherein a distal end of each of the first and second hinge flaps is configured to secure to the corresponding outer flap adjacent the rear outer flap.

2. The seat cover of claim 1 wherein at least one of the inner and outer flaps is tapered.

3. The seat cover of claim 1 wherein each inner flap secures to the corresponding outer flap using at least one hook and loop fastener, and wherein each of the first and second hinge flaps secures to the corresponding outer flap adjacent the rear outer flap using at least one hook and loop fastener.

4. The seat cover of claim 1 wherein each inner flap is smaller than the corresponding outer flap.

5. The seat cover of claim 1 wherein the first hinge flap and the second hinge flap are both smaller than the rear outer flap.

6. The seat cover of claim 1 wherein the material comprises a fleece material.

7. A seat cover for a toilet seat configured to hingedly connect to a toilet base via two spaced apart hinges, the toilet seat comprising an inner rim defining an opening of the toilet seat, an opposing outer rim including a rear portion proximate the two spaced apart hinges, a top side spanning between the inner and outer rims, and an opposing bottom side spanning between the inner and outer rims, the seat cover comprising:

a seat surface comprising a ring of material having a top surface and an opposing bottom surface, the top and bottom surfaces spanning between an inner peripheral edge and an outer peripheral edge, the inner peripheral edge defining a center opening of the seat cover;

a plurality of outer flaps along the outer peripheral edge; and a plurality of inner flaps along the inner peripheral edge;

wherein each outer flap is configured to extend around the outer rim of the toilet seat and each inner flap is configured to extend around the inner rim of the toilet seat such that each inner flap secures to a corresponding outer flap at the bottom side of the toilet seat to secure the bottom surface of the seat cover to the top side of the toilet seat;

wherein the plurality of outer and inner flaps comprise:

a first outer flap disposed along a rear outer peripheral edge of the seat cover and configured to fit between the two spaced apart hinges when extended around a rear outer rim of the toilet seat and secure to a corresponding first inner flap;

a second outer flap disposed on a front outer peripheral edge of the seat cover opposite the rear outer peripheral edge and configured to extend around a front outer rim of the toilet seat and secure to a corresponding second inner flap;

a pair of third outer flaps disposed along one side outer peripheral edge of the seat cover between the first outer flap and the second outer flap, each third outer flap configured to extend around a lateral outer rim of the toilet seat and secure to a corresponding third inner flap, the pair of third outer flaps comprising a rear third outer flap disposed proximate the first outer flap and a front third outer flap disposed proximate the second outer flap; and a pair of fourth outer flaps disposed along another side outer peripheral edge of the seat cover between the first outer flap and the second outer flap, each fourth outer flap configured to extend around another lateral outer rim of the toilet seat and secure to a corresponding fourth inner flap, the pair of fourth outer flaps comprising a rear fourth outer flap disposed proximate the first outer flap and a front fourth outer flap disposed proximate the second outer flap;

a fifth outer flap disposed along the rear outer peripheral edge of the seat cover between the first outer flap and the rear third outer flap, said fifth outer flap configured to extend around at least a portion of the rear outer rim of the toilet seat adjacent one of the two spaced apart hinges and secure to the rear third outer flap; and a sixth outer flap disposed along the rear outer peripheral edge of the seat cover between the first outer flap and the fourth rear outer flap, said sixth outer flap configured to extend around at least a portion of the rear outer rim of the toilet seat adjacent the other one of the two spaced apart hinges and secure to the rear fourth outer flap.

8. The seat cover of claim 7 wherein:

the second outer flap is bigger than the first outer flap; and the fifth and sixth outer flaps are smaller than any of the other outer flaps.

9. The seat cover of claim 7 wherein:

a width of the each of the rear third and rear fourth outer flaps in the pairs of third and fourth outer flaps is at least twice as wide as a width of the first outer flap;

the width of the first outer flap is at least twice as wide as a width of the fifth outer flap;

the width of the first outer flap is at least twice as wide as a width of the sixth outer flap; and a width of the second outer flap is at least 50% wider than the width of the first outer flap.

10. The seat cover of claim 7 wherein the seat cover is for use on a round toilet seat, and wherein a width of the second inner flap is wider than a width of the first inner flap.

11. The seat cover of claim 10 wherein the rear outer peripheral edge of the seat cover is arced, and wherein the first, fifth, and sixth outer flaps are adjacently disposed along the arced rear outer peripheral edge of the seat cover.

12. The seat cover of claim 7 wherein the seat cover is for use on an oval toilet seat.

13. The seat cover of claim 12 wherein the rear outer peripheral edge of the seat cover is substantially straight, and wherein the first, fifth, and sixth outer flaps are disposed along the substantially straight rear outer peripheral edge of the seat cover.

14. The seat cover of claim 7 wherein the material comprises a fleece material.

* * * * *